US007159809B1

(12) United States Patent
Cheng

(10) Patent No.: US 7,159,809 B1
(45) Date of Patent: Jan. 9, 2007

(54) WASTE FOOD PROCESSOR

(76) Inventor: Yu-Lung Cheng, No. 83, Fuguang 6th Lane, Wuguang Rd., Wurih Township, Taichung County 414 (TW)

( * ) Notice: Subject to any disclaimer, the term of this patent is extended or adjusted under 35 U.S.C. 154(b) by 0 days.

(21) Appl. No.: 11/384,996

(22) Filed: Mar. 20, 2006

(51) Int. Cl.
*B02B 5/02* (2006.01)
*B02C 13/10* (2006.01)

(52) U.S. Cl. ..... 241/101.2; 241/159

(58) Field of Classification Search ..... 241/101.2, 241/152.1, 159, 166, 167
See application file for complete search history.

(56) References Cited

U.S. PATENT DOCUMENTS 926,168 A * 6/1909 Cadwgan ..... 241/222
1,530,615 A * 3/1925 Pohl ..... 241/111
2,684,205 A * 7/1954 Grimard ..... 241/43
3,491,952 A * 1/1970 Krolopp ..... 241/13
5,031,845 A * 7/1991 Gemsjager ..... 241/78

* cited by examiner

*Primary Examiner*—Faye Francis
(74) *Attorney, Agent, or Firm*—Alan D. Kamrath; Nikolai & Mersereau, P.A.

(57) ABSTRACT

A waste food processor has a housing with an upper room and a lower room communicated with each other, a first grinding assembly and a second grinding assembly respectively received within the upper and lower rooms, and a cleaning assembly connected to the first grinding assembly for cleaning residues remained on the first grinding assembly to make the removed residues further processed by the second grinding assembly. Particularly, the first grinding assembly is composed of a first toothed drum and second toothed drum respectively with different sharp teeth and cutouts to make engaging gaps in different sizes so that solid residues in large sizes also can be introduced between the first and second drums for grinding. Thereby, grinding capability and efficiency of the waste food processor are significantly improved.

5 Claims, 5 Drawing Sheets

WASTE FOOD PROCESSOR

BACKGROUND OF THE INVENTION

1. Field of the Invention

The present invention relates to a waste food processor, and more particularly to a waste food processor that has excellent grinding efficiency for treating waste food to be disposable to drainage.

2. Description of Related Art

A conventional waste food processor substantially has a motor to drive two oblique gears rotating oppositely so that the waste food dropped on the two oblique gears is crunched therebetween into residues. Then, the residues are further fined and brought out along by a spiral blade.

However, the fined residues easily stick on the oblique gears and do not drop to the spiral blade for further grinding so that the conventional waste food processor can not perform full grinding efficiency.

Moreover, only hard residues in small sizes can be introduced into engaging gaps between the oblique gears because the engaging gaps are small. When hard residues in large sizes such as bones are treated in the conventional waste food processor, the hard residues can not be ground by the oblique gears simply driven by motor since the size is over so that the hard residues in large sizes do not drop and can not be further treated by the spiral blade.

According to above description, the conventional waste food processor still has some drawbacks in practice.

SUMMARY OF THE INVENTION

A main objective of the present invention is to provide a waste food processor that keeps no residues on grinding assembly so that the grinding efficiency is thus improved.

To achieve the foregoing objective, the waste food processor comprises:

a housing having an upper room, a lower room communicated to the upper room and a detachable cover mounted on the housing to cover the upper room and the lower room;

a first grinding assembly accommodated inside the upper room and comprising a first toothed drum rotatably received inside the housing and having a first central shaft axially penetrating the first toothed drum, a first outer periphery, multiple first ribs formed on the first outer periphery, and multiple cutouts defined on each of the multiple first ribs to perform sharp teeth on the first toothed drum, wherein the first central shaft has one end extending out of the housing and a first gear disk and a second gear disk mounted on the first central shaft of the first toothed drum; and a second toothed drum rotatably received inside the housing, engaged the first toothed drum and comprising a second outer periphery, multiple second ribs formed on the second outer periphery, and multiple extended cutouts defined on each of the multiple second ribs to perform engaging gaps with the first toothed drum;

a cleaning assembly rotatably received inside the upper room in the housing and comprising a third toothed drum and a fourth toothed drum respectively engaged the first toothed drum and the second toothed drum;

a second grinding assembly accommodated inside the lower room and comprising a fifth toothed drum rotatably received inside the housing and having a second central shaft axially penetrating the fifth toothed drum, wherein the second central shaft has one end extending out of the housing and a third gear disk mounted on the second central shaft of the fifth toothed drum; and a sixth toothed drum rotatably received inside the housing and engaged the fifth toothed drum;

a chain looping the first gear disk on the first shaft of the first toothed drum and the third gear disk on the second shaft of the fifth toothed drum; and a motor driving the second gear disk on the first shaft of the first toothed drum to actuate the waste food processor.

By using the third and fourth drums to clean the first and second drums, no residues are remained on the first and second drum and grinding efficiency is thus improved.

Further benefits and advantages of the present invention will become apparent after a careful reading of the detailed description with appropriate reference to the accompanying drawings.

DETAILED DESCRIPTION OF THE PREFERRED EMBODIMENT

Figure 1:
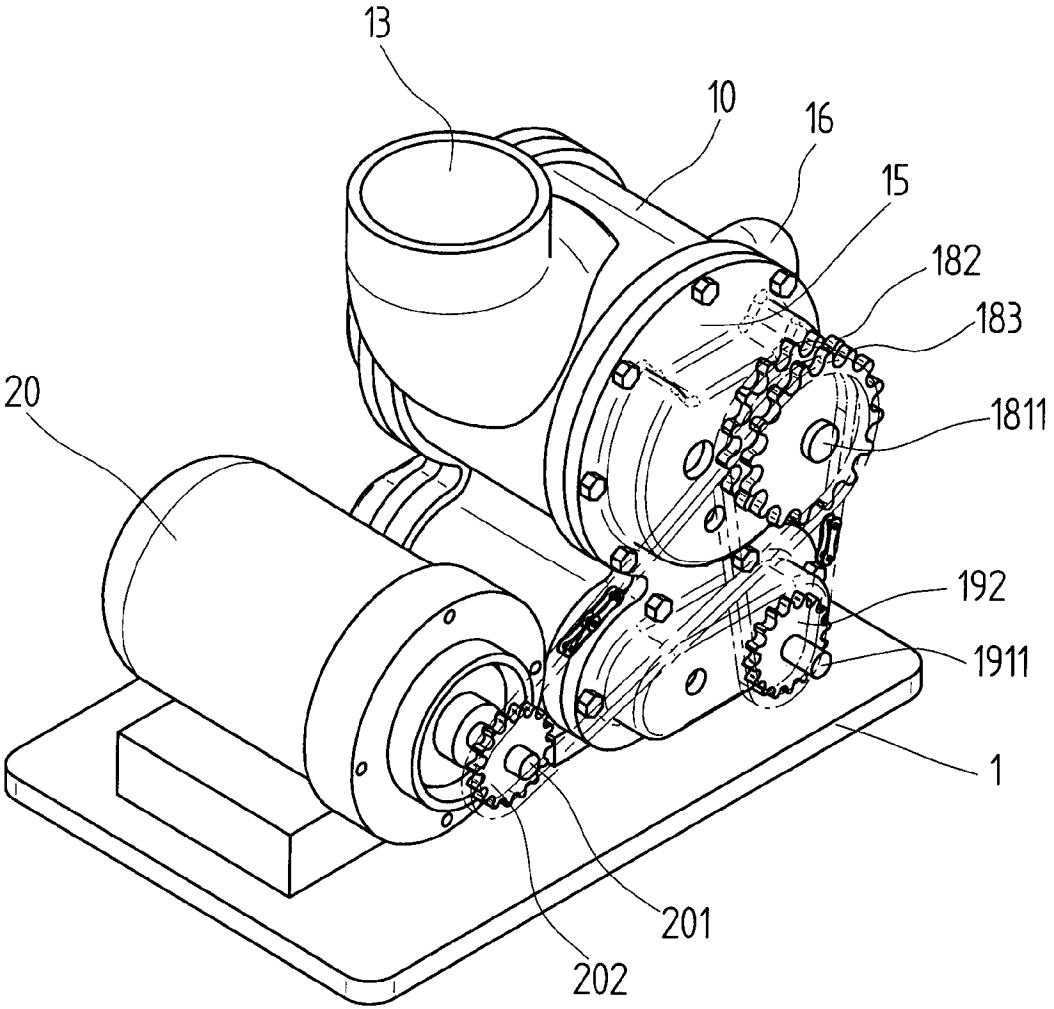
FIG. 1 is a perspective view of a waste food processor in accordance with the present invention.

A waste food processor in accordance with the present invention comprises a housing with an upper room and a lower room communicated with each other, a first grinding assembly and a second grinding assembly respectively received within the upper and lower rooms, and a cleaning assembly connected to the first grinding assembly for cleaning residues remained on the first grinding assembly to make the removed residues further processed by the second grinding assembly. Particularly, the first grinding assembly is composed of a first toothed drum and second toothed drum respectively with different sharp teeth and cutouts to make engaging gaps in different sizes so that solid residues in large sizes also can be introduced between the first and second drums for grinding. Thereby, grinding capability and efficiency of the waste food processor are significantly improved With reference to FIGS. 1 to 4, the waste food processor comprises a base board 1, a housing 10, a first grinding assembly 18, a second grinding assembly 19 and a cleaning assembly 185, 186.

Figure 2:
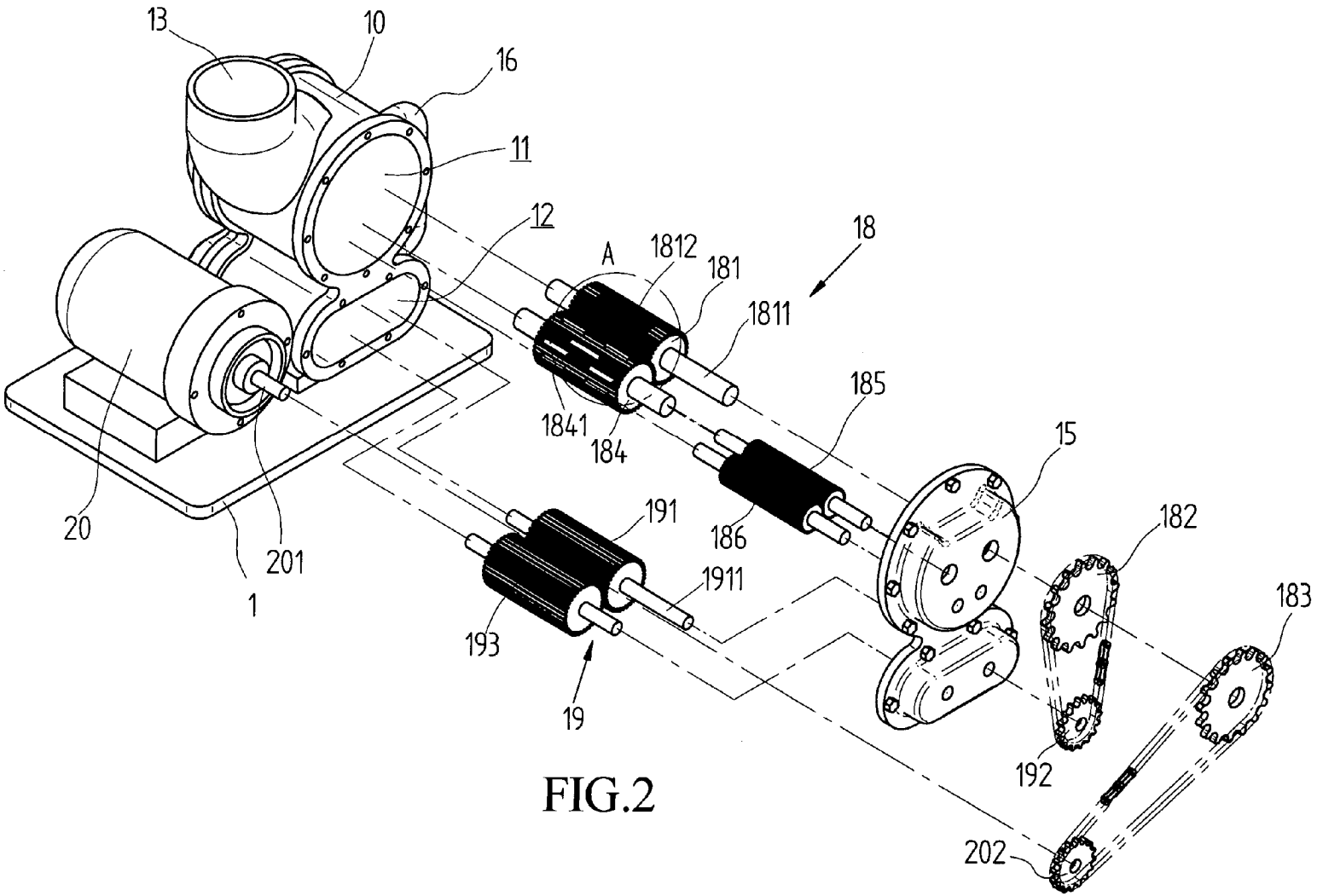
FIG. 2 is an exploded perspective view of the waste food processor in FIG. 1.
Figure 3:
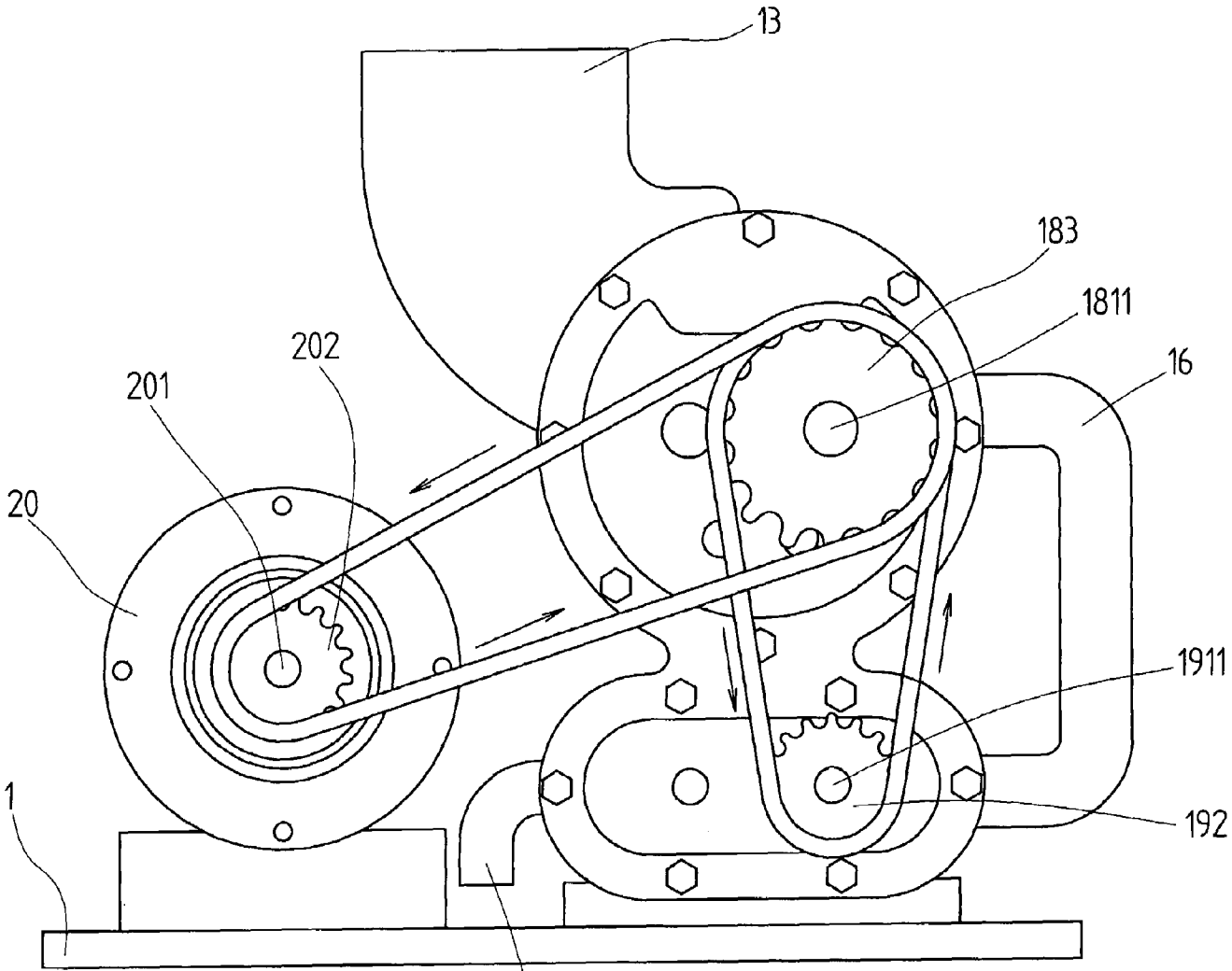
FIG. 3 is a side plan view of the waste food processor.
Figure 4:
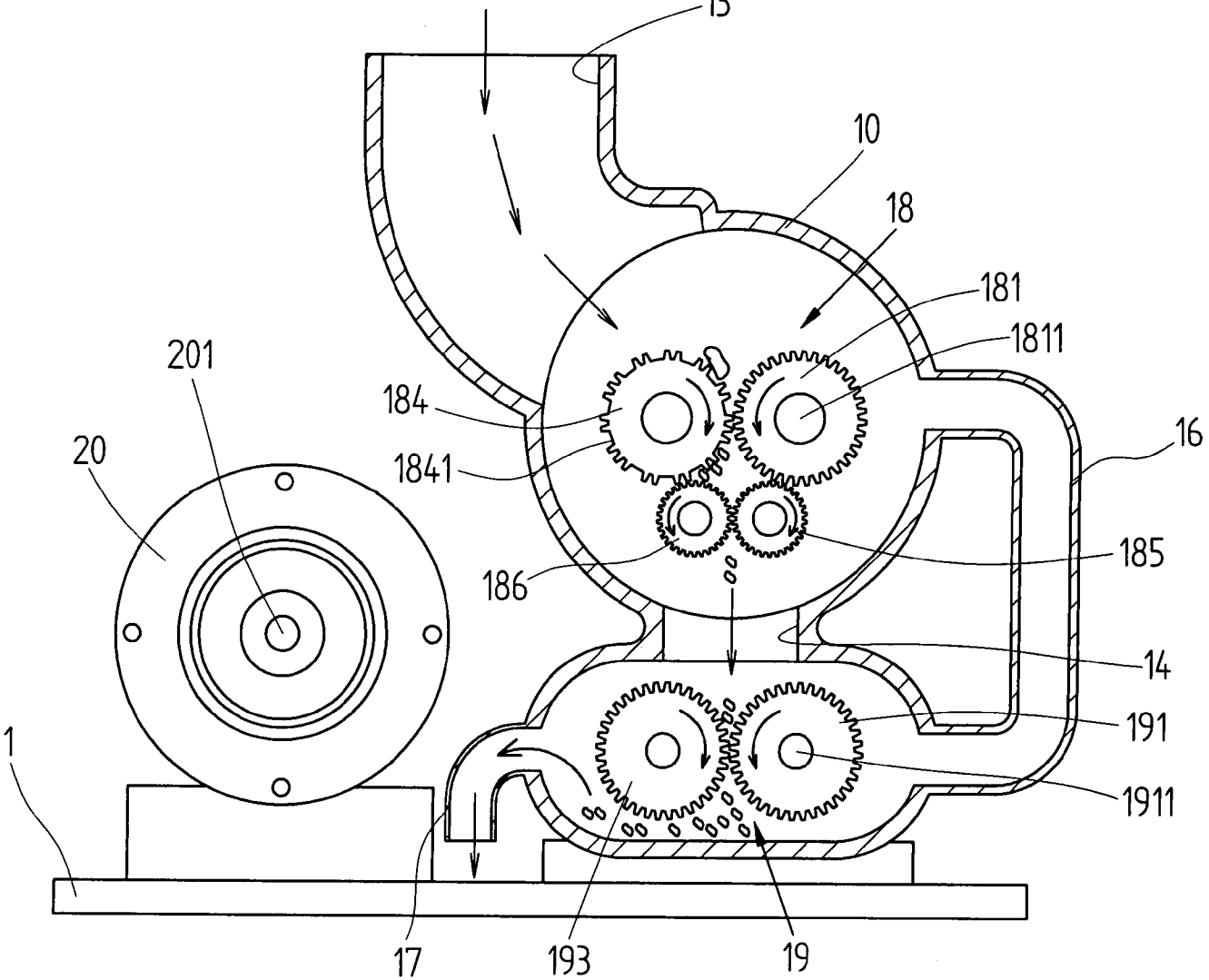
FIG. 4 is a schematically operational side plan view of the waste food processor.

The housing 10 is mounted on the base board 10 and has an upper room 11 and a lower room 12 (as shown in FIG. 2). The housing 10 has a top, and an inlet 13 defined at the top of the housing 10 and adapted to connect to a drain pipe (not shown) of a sink. A neck is formed at junction of the upper room 11 and the lower room 12 and has a channel 13 defined therein to communicate the upper and lower rooms 11, 12 (as shown in FIG. 4). The housing 10 has two sides, a cover 15 detachably attached to one side and a bypass 16 attached to another side (as shown in FIGS. 3 and 4). The bypass 16 has two ends respectively communicated with the upper and lower rooms 11, 12, wherein the bypass 16 is U-shaped. Moreover, an outlet 17 is formed on the housing 10 near the base plate 1 to communicate the lower room 12.

Figure 2A:
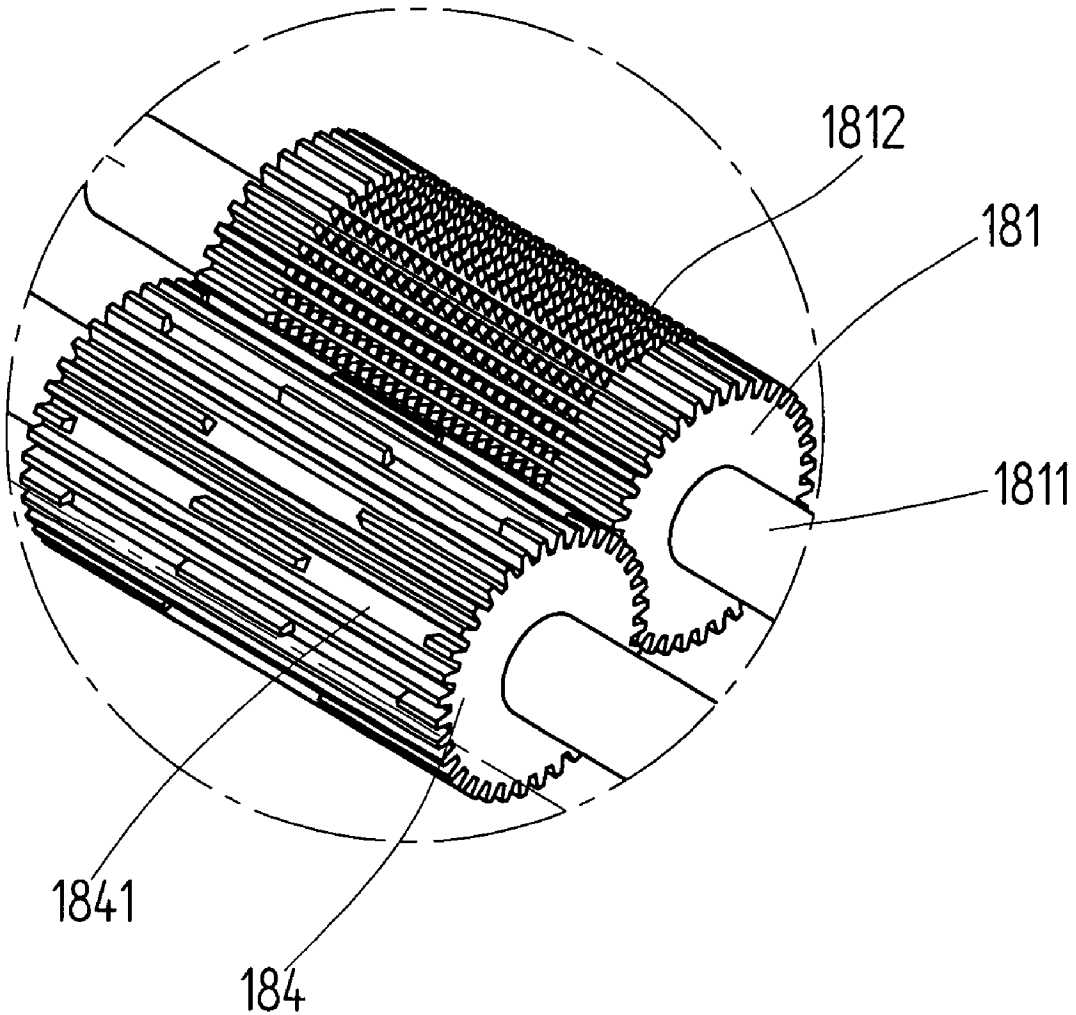
FIG. 2A is an enlarged perspective view of a first grinding assembly in the waste food processor as shown in FIG. 2.

The first grinding assembly 18 is accommodated inside the upper room 11 in the housing 10 (as shown in FIGS. 2 and 4) and comprises a first toothed drum 181 axially penetrated by a central shaft 1811 and a second toothed drum 184, wherein both toothed drums 181, 184 are rotatably attached inside the upper room 11. Two ends of the central shaft 1811 on the first toothed drum 181, one attaches to an inner wall of the upper room 11 and the other penetrates through the cover 15 to engage two gear disks 182, 183 in sequence. The first toothed drum 181 has an outer periphery, multiple ribs and multiple cutouts 1812 defined in a middle portion of each rib to perform multiple sharp teeth on the outer periphery for grinding (as shown in FIG. 2A). The second toothed drum 184 snugly engages the first toothed drum 181 and also has an outer periphery, multiple ribs formed on the outer periphery of the second toothed drum 184 and multiple extended cutouts 1841 randomly defined on each rib on the second toothed drum 184 to perform engaging gaps in different sizes between the first and second toothed drums 181, 184 (As shown in FIG. 2A). Moreover, the cleaning assembly is attached under the first grinding assembly 18 and has a third toothed drum 182 and fourth toothed drum 183 respectively engaged the first and second toothed drum 181, 184. Preferably, the third and fourth toothed drums 182, 183 engage with each other.

The second grinding assembly 19 is accommodated inside the lower room 12 near the outlet 17 (as shown in FIGS. 2 and 4) and comprises a fifth toothed drum 191 axially penetrated by a central shaft 1911 and a sixth toothed drum 193, wherein both toothed drums 191, 193 are rotatably attached inside the lower room 12. Two ends of the central shaft 1911 on the fifth toothed drum 191, one attaches to the inner wall of the upper room 11 and the other penetrates through the cover 15 to engage a gear disk 192.

Additionally, a motor 20 is mounted on the base board 1 near the housing 10 and has a driving shaft 201 with a gear disk 202 connected to the gear disk 182 on the central shaft 1811 of the first toothed drum 181 by a chain to drive the first toothed drum 181. Meanwhile, another gear disk 183 on the central shaft 1811 of the first toothed drum 181 rotates in synchronization to drive the gear disk 192 on the central shaft 1911 of the fifth toothed drum 191.

When the waste food processor of the present invention is used in practice (as shown in FIG. 4), the motor 20 is actuated to drive the first toothed drum 181 to rotate (as shown in FIGS. 1 and 3). Thereby, the first toothed drum 181 directly or indirectly drives the second, third and fourth toothed drum 184, 185, 186. When the waste food and water from the sink are guided into the upper room 11 via the inlet 13, the waste water directly drops from the upper room 11 to the lower room 12 via the channel 14 and drain out via the outlet 17. When the waste water is suddenly poured into the upper room 11 in a great amount with the waste food, the waste water is temporarily accumulated inside the upper room 11 since channel 14 at the neck is narrow. In this situation, the bypass 16 provides another way for guiding the waste water to the lower room 12 so as to avoid the waste food floating in the upper room 11 or even reflowing back to the drain pipe with the waste water. Therefore, the waste food is ensured to contact the first grinding assembly 18 and then ground efficiently. Because the engaging gaps between the first and second toothed drums 181, 184 are various, the waste food with large size enables to be received in the engaging gaps and ground between the first and second toothed drums 181, 184 for accomplishing a rough grinding process. When the first and second toothed drums rotate, the waste food is ground therebetween and also paddled after grinding to drop to the cleaning assembly but parts of the waste food remain on the first and second toothed drums. Then, the third and fourth toothed drums 185, 186 of the cleaning assembly gear with the first and second toothed drums to remove residues stuck on the first and second toothed drums 181, 184. The waste food after grinding and the removed residues drops to the lower room 12 on the second grinding assembly 19. In the lower room 12, the waste food and the removed residues are further ground by the fifth toothed drum 191 and the sixth toothed drum 193 and lastly conducted by the fifth and sixth toothed drums 191, 193 to drain out via the outlet 17.

According to above description, one feature of the waste food processor is that waste food in large size enables to be ground because the first toothed drum 181 has multiple cutouts 1812 on each rib to perform the sharp teeth (as shown in FIG. 2) and the second toothed drum 184 has multiple extended cutouts 1841 on the rib to perform the engaging gaps for receiving the waste food even in large size. Another feature of the waste food processor in the present invention is that the third and fourth toothed drums 185, 186 clean the residues stuck on the first and second toothed drums 181, 184 to keep the grinding operation efficient. Still another feature of the waste food processor in the present invention is that the ground waste food and the removed residues are further ground by the second grounding assembly 19 to make final products fine enough to meet drainage standard. Therefore, the waste food processor has excellent grinding capability and efficiency.

Although this invention has been described in its preferred form with a certain degree of particularity, it is understood that the present invention of the preferred form has been made only by way of example and that numerous changes in the details of construction and the combination and arrangement of parts any be resorted to without departing from the spirit and scope of the invention.

What is claimed is:

1. A waste good processor comprising:

a housing having an upper room, a lower room communicated to the upper room and a detachable cover mounted on the housing to cover the upper room and the lower room;

a first grinding assembly accommodated inside the upper room and comprising a first toothed drum rotatably received inside the housing and having a first central shaft axially penetrating the first toothed drum, a first outer periphery, multiple first ribs formed on the first outer periphery, and multiple cutouts defined on each of the multiple first ribs to perform sharp teeth on the first toothed drum, wherein the first central shaft has one end extending out of the housing and a first gear disk and a second gear disk mounted on the first central shaft of the first toothed drum; and a second toothed drum rotatably received inside the housing, engaged the first toothed drum and comprising a second outer periphery, multiple second ribs formed on the second outer periphery, and multiple extended cutouts defined on each of the multiple second ribs to perform engaging gaps with the first toothed drum;

a cleaning assembly rotatably received inside the upper room in the housing and comprising a third toothed drum and a fourth toothed drum respectively engaged the first toothed drum and the second toothed drum;

a second grinding assembly accommodated inside the lower room and comprising a fifth toothed drum rotatably received inside the housing and having a second central shaft axially penetrating the fifth toothed drum, wherein the second central shaft has one end extending out of the housing and a third gear disk mounted on the second central shaft of the fifth toothed drum; and a sixth toothed drum rotatably received inside the housing and engaged the fifth toothed drum;

a chain looping the first gear disk on the first shaft of the first toothed drum and the third gear disk on the second shaft of the fifth toothed drum; and a motor driving the second gear disk on the first shaft of the first toothed drum by a chain to actuate the waste food processor.

2. The waste food processor as claimed in claim 1, wherein the housing further has a top and an inlet defined at the top and adapted to communicate with a drain pipe of a sink.

3. The waste food processor as claimed in claim 1, wherein the housing further has a neck between the upper room and the lower room and a channel defined within the neck to communicate the upper room and the lower room.

4. The waste food processor as claimed in claim 1, wherein the housing further has a bypass extending out and communicating the upper room and the lower room, wherein the bypass is U-shaped; and an outlet defined in the housing near a bottom of the housing and to communicate with the lower room.

5. The waste food processor as claimed in claim 1, wherein the third toothed drum engages the fourth toothed drum.

* * * * *